US006513898B1

(12) United States Patent
Vigna et al.

(10) Patent No.: US 6,513,898 B1
(45) Date of Patent: Feb. 4, 2003

(54) INTEGRATED INKJET PRINT HEAD AND MANUFACTURING PROCESS THEREOF

(75) Inventors: Benedetto Vigna, Potenza (IT); Riccardo Maggi, Certosa di Pavia (IT)

(73) Assignee: STMicroelectronics S.r.l., Agrate Brianza (IT)

( * ) Notice: Subject to any disclaimer, the term of this patent is extended or adjusted under 35 U.S.C. 154(b) by 0 days.

(21) Appl. No.: 09/103,016

(22) Filed: Jun. 23, 1998

(30) Foreign Application Priority Data

Jun. 27, 1997 (EP) ..... 97830321

(51) Int. Cl.[7] ..... B41J 29/393; B41J 2/85
(52) U.S. Cl. ..... 347/19; 347/67
(58) Field of Search ..... 347/14, 19, 67

(56) References Cited

U.S. PATENT DOCUMENTS

| | | | | | |
|---|---|---|---|---|---|
| 3,938,175 | A | * | 2/1976 | Jaffe et al. | 357/26 |
| 4,293,867 | A | * | 10/1981 | Isayama | 347/92 |
| 5,734,391 | A | * | 3/1998 | Tanaka et al. | 347/14 |
| 5,891,751 | A | * | 4/1999 | Kurtz et al. | 438/53 |
| 5,894,161 | A | * | 4/1999 | Akram et al. | 257/48 |
| 5,963,788 | A | * | 10/1999 | Barron et al. | 438/48 |

FOREIGN PATENT DOCUMENTS

| | | | |
|---|---|---|---|
| EP | 0 334 546 | 9/1989 | B41J/3/04 |
| EP | 0 593 133 | 4/1994 | B41J/2/16 |
| JP | 404029851 A * | 1/1992 | |

OTHER PUBLICATIONS

European Search Report from European Patent Application 97830321.2 filed Jun. 27, 1997.

Patent Abstracts of Japan, vol. 017, No. 059, Feb. 5, 1993 & JP–A–04 269549 (Seiko Epson Corp.).

* cited by examiner

*Primary Examiner*—John Barlow
*Assistant Examiner*—Michael S Brooke
(74) *Attorney, Agent, or Firm*—Wolf, Greenfield & Sacks, P.C.; James H. Morris

(57) ABSTRACT

An inkjet print head includes an ink drop emission mini-gun and a drop emission sensor integrated in a chip of semiconductor material. The mini-gun is formed by an ink chamber and a nozzle in communication with the ink chamber and the drop emission sensor includes a resistive element arranged in a position adjacent to the ink chamber. The resistance of the resistive element depends on the pressure exerted thereon, so that when the mini-gun emits an ink drop, it is subjected to a recoil movement which causes a change of pressure and hence of resistance in the resistive element; this change in resistance may be detected through suitable circuitry to identify whether and when a drop of ink has been emitted.

13 Claims, 3 Drawing Sheets

INTEGRATED INKJET PRINT HEAD AND MANUFACTURING PROCESS THEREOF

BACKGROUND OF THE INVENTION

1. Field of the Invention

The invention relates to an integrated inkjet print head and the manufacturing process thereof.

2. Discussion of the Related Art

As is known, inkjet print heads based on different technologies and with different print qualities and speeds, as well as costs, are currently available on the market.

The most widespread technologies are based on thermal and piezoelectric methods. Thermal print heads have one or more "mini-guns" including an ink chamber connected to an ink ejection nozzle and having a heater element located on the base of the ink chamber and formed by a resistor. A very small quantity of ink (of the order of picoliters), present in the ink chamber, is heated quickly by the heater element; boiling generates a bubble which, on collapsing, causes the ink to come out of the nozzle. The change of pressure which takes place inside the chamber draws from the reservoir, connected to the ink chamber by means of a suitable duct, another small quantity of ink which can again be heated and projected to the outside. With this method the frequency with which the drops can be expelled thus depends on the heating time and the re-charging speed.

The piezoelectric method makes use of the property of a number of materials, such as quartz, to contract if subjected to electric field. This behavior is exploited to generate a pressure on a capillary containing ink. The pressurized liquid comes out of the nozzle located in the direction of the support to be printed. In this case the frequency with which the drops of ink can be generated by the nozzle depends on the physical characteristics of the vibrating component, and on the recharging time of the capillary.

For a rapid survey of the two methods discussed above, reference may be made, for example, to U.S. Pat. No. 4,543,530 which also shows the structure of a thermal-type head, and the article "Inkjet: tecnologie a confronto" ("Inkjet: technologies compared") in PC MAGAZINE, April 95, pp. 200–210. Furthermore, another structure of a thermal-type head is shown in U.S. Pat. No. 5,103,246.

In both methods, the shape of the drop of ink ejected is of fundamental importance. In fact, the more spherical the drop, the better the print quality. To obtain this result it is necessary to act so that the ink is subjected to a change in pressure which is as violent and at the same time as short as possible. The method which enables this shape to be obtained most satisfactorily and most easily is the thermal method. To induce a rapid change in pressure the heater element is caused, by Joule effect, to generate heat such as to cause a temperature change in the ink of 100° C./$\mu$s. The nucleation of the bubble requires approx. 3 $\mu$s while its growth involves times of 3–10 $\mu$s; collapse involves times of 10–20 $\mu$s, while the re-charging of the ink requires approximately 80 $\mu$s.

It is evident that the times, temperatures and pressures involved induce considerable stress in the heater elements, reducing their average lifetime. It is therefore desirable to devise arrangements capable of reducing the stress to which the heater element is subjected. In particular, it is conceivable to calibrate the minimum energy to be supplied to the heater element, by means of a sequence of "shots" or emissions of the drops.

Furthermore, to avoid damage to the head and its components and to indicate the need to replace them, in these heads it is also important to check whether the emission nozzle is blocked or whether any part of the head, such as the heater element, is damaged.

SUMMARY OF THE INVENTION

The object of the invention is therefore to improve an inkjet print head in order to eliminate the above-mentioned disadvantages.

The invention provides an integrated inkjet printhead and a manufacturing process therefore.

According to one embodiment of the invention, an inkjet printhead is provided including an integrated device emitting ink drops and formed by an ink chamber and by a nozzle in communication with the ink chamber, including a drop emission sensor arranged in a position adjacent to the ink chamber.

According to another embodiment of the invention, a process is provided for manufacturing an inkjet printhead, including the steps of forming an ink chamber and a nozzle in communication with said ink chamber, and forming a drop emission sensor in a position adjacent to said ink chamber.

In practice, the invention is based on the knowledge that at the moment of emission of a drop of ink, in a direction perpendicular to the silicon chip, by virtue of momentum conservation the latter is subjected to a recoil movement. Thus, by arranging a movement sensor in the proximity of the ink chamber or of each ink chamber of the head it is possible to detect the emission of the drops of ink in real time. In view of the fact that this movement causes a change in the pressure exerted on the mini-gun support structure, advantageously this movement may be noted by detecting differences in the pressure exerted on that structure. In particular, it is possible to arrange a resistive element on the wall of the ink chamber opposite the ink emission nozzle, the resistor having a resistance variable as a function of the pressure exerted on it. A suitable circuit connected to this resistive element and capable of detecting its changes of resistance thus enables one to identify whether and when a drop of ink is emitted. The resistive element may be made of single-crystal silicon, integrated into the substrate, or of multi-crystal silicon, on top of the wafer and beneath the heater element. Advantageously the sensor may be integrated together with the components of the circuitry for the control and detection of the emission of the drops of ink, using the usual known monolithic manufacturing methods.

BRIEF DESCRIPTION OF THE DRAWINGS

For an understanding of the invention two preferred embodiments thereof will now be described, purely by way of non-exhaustive example, with reference to the accompanying drawings in which.

DETAILED DESCRIPTION

Figure 1:
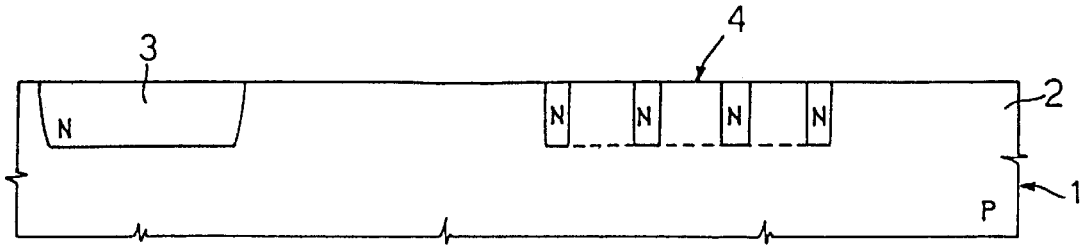
FIG. 1 shows a transverse section through a wafer of semiconductor material in a manufacturing step of a first embodiment of this head.

FIG. 1 shows a wafer 1 of single-crystal silicon comprising a substrate 2 in which, during the step of forming the wells required for the components of the circuitry (of which a well 3 is shown in the illustration), at least one resistive element forming the sensor 4 is also implanted or diffused. If the head provides a plurality of mini-guns, the same number of sensors 4 will of course be formed. In the illustrated example the substrate 2 is P-type, the well 3 and the resistive element 4 are N-type. It is, however, possible to exchange the type of conductivity of the substrate and of the resistive element 4. In the illustrated case of N-type resistive element 4, it may have a resistivity of approx. 1–3 kΩ/□ and a depth between 6 and 8 μm. Preferably the resistive element 4 is shaped like a coil, as discussed in detail below.

The wafer 1 is then subjected to the usual, per se known process steps required to form the circuit, contact the resistive element 4 and form the ink chamber. In particular and with reference to FIG. 2, on the entire surface of the wafer 1, apart from the active areas, a thick field oxide layer 8 is grown first of all; inter alia, the field oxide layer 8 extends above the zone 1*a* intended to accommodate the "mini-gun" and in particular above the resistive element 4 also, apart from openings 8' for producing the contacts of the resistive element 4. Then, in a manner which is known and not described, the integrated components of the circuitry are formed, of which is shown an NPN transistor 29, formed in the well 3 and having collector formed by the well 3 and by the enriched contact region 5, base formed by a P-type region 6, inside the well 3, and emitter formed by an $N^+$-type region 7 inside the base region 6.

Then, a dielectric layer 9 (such as BPSG, Boron Phosphorus Silicon Glass) is deposited on top of the field oxide (where present) or the surface of the wafer 1. The dielectric layer 9 is opened and removed from the openings 8' of the field oxide layer 8 to produce the electrical connections to the components and the sensor 4; a first metallic connection layer, forming contacts 10, 11 and 12—emitter, base and collector respectively—for the transistor 29, contacts 13 for the sensor 4 (passing through both the dielectric layer 9 and the field oxide layer 8 and only one of which is visible in FIG. 2) and contacts 14 (only one of which is visible in FIG. 2) for the heater element is deposited and formed. Then (or even before the contacts 11–14 are formed) a metallic layer, preferably of tantalum/aluminium, is deposited and shaped, to form the heater element 15 which is only partially visible in FIG. 2 and whose overall form is visible in the view of FIG. 3. Alternatively the heater element 15 may also be made of multi-crystal silicon. The heater element 15 is arranged above the sensor 4, as can be seen more clearly in FIG. 3.

A dielectric material layer 16 (including a second wall region 16A), such as the layer of dielectric normally used to separate the first from the second metal level (when present) or the passivation layer is then deposited. The wafer 1 is then subjected to the cutting and separation steps; a polymeric layer 20 (also called a barrier layer) is then deposited on each linished chip and is subjected to known forming steps (by means of laser piercing, sandblasting or chemical etching, see for example the U.S. Pat. No. 5,103,246 referred to above), to form the ink chamber(s) 21 in a manner aligned with the heater elements 15. Finally, a top layer 22, including a first wall region 22A, (also called orifice board), also preferably of polymeric material, is formed, shaped so as to have orifices 23 forming the ink emission nozzles, thus providing the final structure of the inkjet head 30 shown in FIG. 3. In this illustration 25 denotes the ink present in the ink chamber 21.

As noted, the sensor 4 detects the pressure generated by the recoil movement caused by the emission of a drop of ink and modifies its resistance value. In particular the change in resistance ΔR associated with the pressure difference caused by the recoil movement following the emission of a drop of ink is given by the following formula:

$$\Delta R/R=\pi_T\Sigma \tag{1}$$

where R is the resistance of the sensor 4 in the absence of stress, $\pi_T$ is the transverse piezo-resistivity coefficient which depends on the material (and specifically whether it is P or N doped) and on the doping level of the resistive element and on the temperature; and Σ is the stress induced by the emission of the drop. Given that the mass of the drop of ink is extremely small with respect to the overall size of the chip it is possible to approximate the stress Σ to the pressure P exerted by the emission of the drop of ink. The equation (1) may therefore be simplified as follows:

$$\Delta R/R=\pi_T P \tag{2}$$

Figure 2:
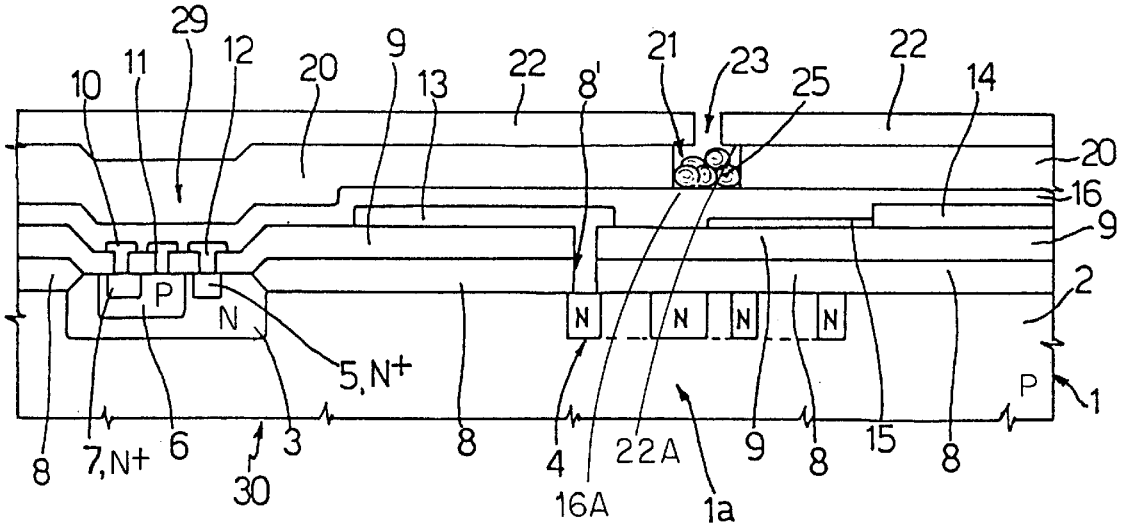
FIG. 2 shows a transverse section along two parallel planes, taken along line II—II of FIG. 3, at the end of manufacture.
Figure 3:
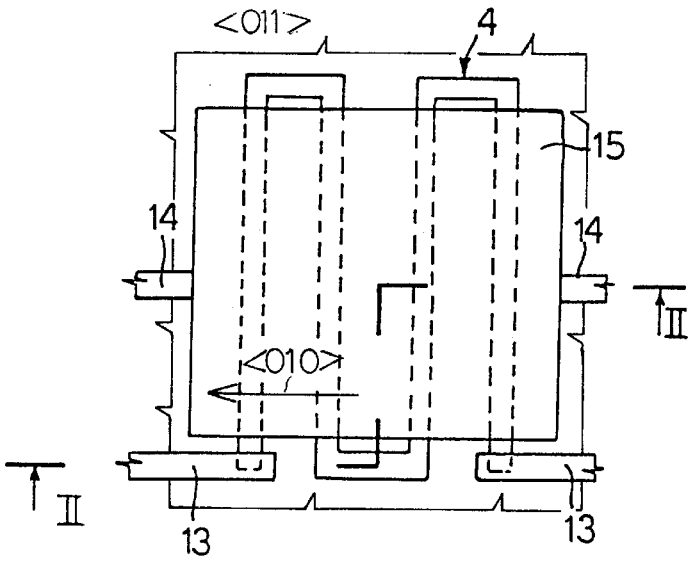
FIG. 3 shows a top view of the head of FIG. 2, with parts removed.
Figure 4:
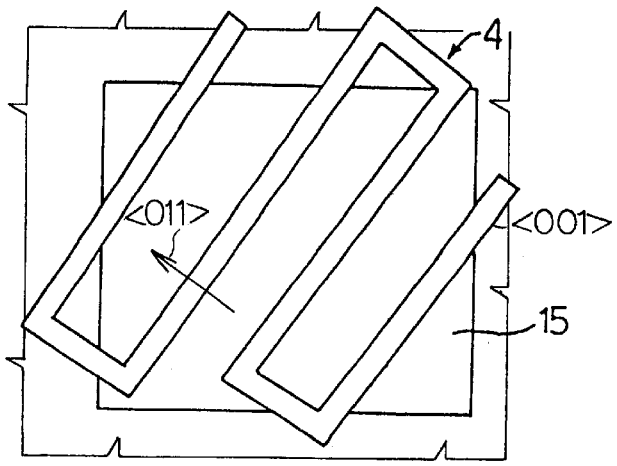
FIG. 4 shows a top view of a variant of FIG. 3.

In the embodiment shown in FIGS. 1 and 2 in which the sensor is made of single crystal silicon, in addition to the factors noted above the coefficient $\pi_T$ depends on the orientation of the resistive element with respect to the crystallographic axes of the lattice of the substrate 2. In this connection reference may be made, for example, to "A Grafical Representation of the Piezoresistance Coefficients in Silicon" by Yozo Kanda in IEEE Transactions on Electron Devices, Vol. ED-29. No. 1, January 1982, pp. 64–69 which is incorporated herein by reference. In this case, therefore, to increase the sensitivity of the sensor 4 it is necessary to orient the resistive element on the basis of its doping. For example, if the silicon wafer has <001> orientation and the sensor is N-type, the resistive element must be orientated according to the <010> axis as shown in FIG. 3. Vice versa, if the substrate 1 has the same above orientation and the sensor is P-type, the resistive element must be oriented according the <011> axis as shown in FIG. 4. Thus, this case also refers to the same <001> orientation of the substrate discussed for FIG. 3.

Figure 5:
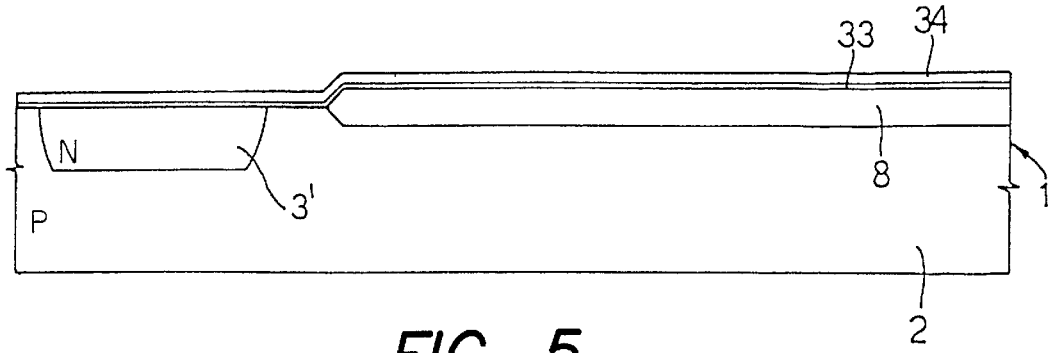
FIG. 5 shows a transverse section through a wafer of semiconductor material in a manufacturing step of a second embodiment of this head.
Figure 6:
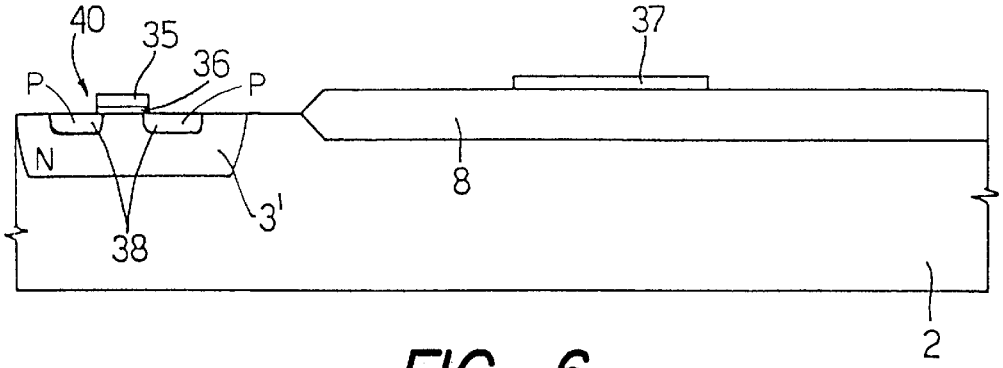
FIG. 6 shows a transverse section similar to that of FIG. 5 in a successive manufacturing step.
Figure 7:
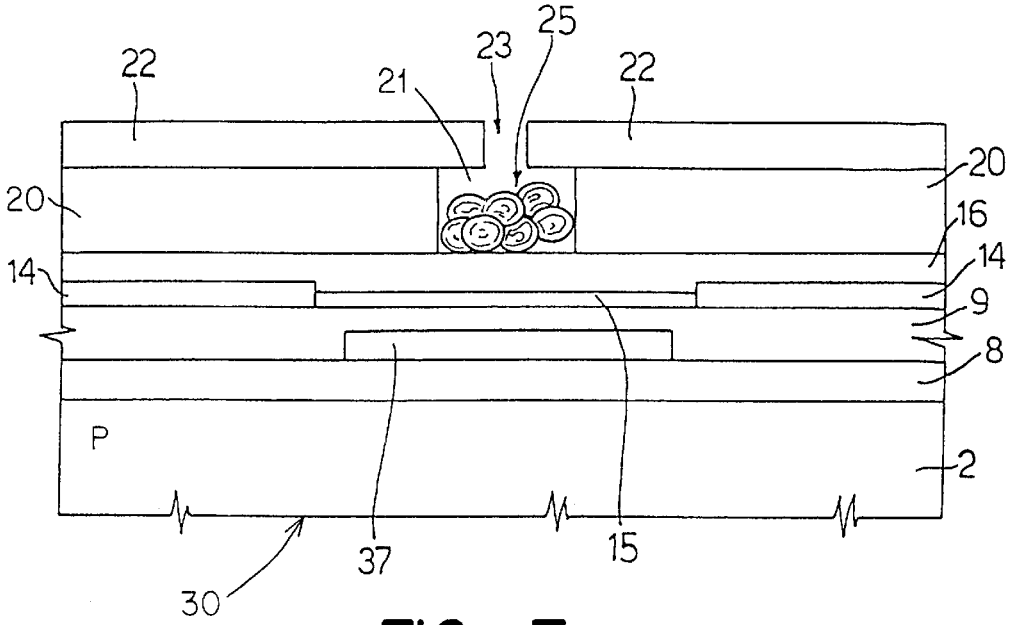
FIG. 7 is a transverse section similar to that of FIGS. 5 and 6, at the end of manufacture.

In the embodiment of FIGS. 5–7 in which the parts common to FIGS. 1–4 are denoted by the same reference numerals, the inkjet head 40 comprises an emission sensor of multi-crystal silicon deposited on top of the wafer 1. In detail, FIG. 5 shows a substrate 2 of P-type single-crystal semiconductor material in which an N-type well 3' is present; also present are the field oxide layer 8, to delimit the active areas, a gate oxide layer 33, covering the field oxide layer 8 and the free surface of the wafer 1, and a multi-crystal silicon layer 34 superimposed on the gate oxide layer 33. For example, the multi-crystal silicon layer 34 may have a thickness between approx. 0.3 and 0.4 μm and a resistivity of 1.5–2 kΩ/□.

Subsequently the layers 33 and 34 are formed, in FIG. 5, and then defined as in FIG. 6, so as to create a gate region 35 of a MOS transistor 40, a gate oxide region 36 and the resistive element 37 forming the drop emission sensor. After the self-aligned implant of the drain and source regions 38 of well 3', the intermediate structure shown in FIG. 6 is obtained in which the portion of gate oxide extending on top of the field oxide region 8 has been omitted.

Next, the dielectric layer 9 is deposited in a manner similar to that described with reference to FIGS. 1 and 2; it is opened to form the electrical connections; a first metal connection layer is deposited and defined, forming the contacts (not shown in FIG. 7) for the MOS transistor, the contacts (not visible in the section of FIG. 7) for the sensor 4 (passing through the sole dielectric layer 9 here) and contacts 14 (both visible in FIG. 7) for the heater element. Then (or even before the contacts are formed), the heater element 15, of tantalum/aluminum, is formed on top of and electrically separated from the sensor 4.

The dielectric material layer 16 is then deposited; the wafer 1 is subjected to cutting and separation steps; the polymeric layer 20 is deposited and drilled on each finished chip to form the ink chamber or chambers 21 in a manner aligned with the heater elements 15. Finally, the top layer 22 with the orifices 23 is formed, thus providing the final structure of the inkjet head 30 shown in FIG. 7, in which the MOS transistor of the circuitry is not shown.

In the embodiment with multi-crystal silicon sensor the orientation of the resistive element 37 does not affect the sensitivity of the sensor, so that it may be formed in the most convenient manner.

Some of the advantages of the inkjet print head described are as follows. Primarily, the fact that the sensor supplies a signal in real time relating to the moment of emission of the drop enables the printing process to be optimized, in particular the printing speed to be increased and the energy to be supplied to the heater element calibrated. This allows a reduction of the dissipated power, as well as of the stress to which the heater element is subjected, to be obtained and hence a longer life of the heater element to be guaranteed.

Furthermore, it is possible to check the functionality of the components (heater element, nozzle and duct) of the head and to generate corresponding fault signals should there be no pressure variation detected by the sensor, to allow the faulty elements to be replaced. Furthermore the signal generated by the sensor may be used in closed-loop control systems to control the operation of the head without the need for external components.

The sensor described may be formed together with the components of the circuitry 29, 40 using the common monolithic manufacturing techniques, hence with low cost, high reliability and repeatability of the results. Finally, the sensor does not involve any increase in the dimensions of the head, given that it is located underneath the ink chamber, thus providing an extremely compact and light structure.

Finally it will be clear that numerous modifications and variants may be introduced to the print head described and illustrated herein, all of which come within the scope of the inventive concept, as defined in the accompanying claims. For example, in the case of a sensor made of multi-crystal silicon, instead of forming a single field oxide layer 8 on the entire zone 1 a where the "mini-guns" are present, it is possible to provide a series of field oxide islands 8 each extending solely underneath a respective ink chamber 21; in this case the contacts of the sensor 4 pass through the sole dielectric layer 9.

Having thus described at least one illustrative embodiment of the invention, various alterations, modifications, and improvements will readily occur to those skilled in the art. Such alterations, modifications, and improvements are intended to be within the spirit and scope of the invention. Accordingly, the foregoing description is by way of example only and is not intended as limiting. The invention is limited only as defined in the following claims and the equivalents thereto.

What is claimed is:

1. An integrated inkjet print head emitting ink drops and comprising; an ink chamber a nozzle in communication with said ink chamber, and a drop emission sensor arranged in a position adjacent to said ink chamber, wherein said integrated head generates a recoil upon the ejection of an ink droplet, and said drop emission sensor senses said recoil;

wherein said drop emission sensor is a pressure sensor arranged adjacent a wall of said ink chamber, opposite said nozzle;

wherein said drop emission sensor is formed by an integrated resistive element;

wherein said integrated resistive element is made of single-crystal silicon;

wherein the integrated resistive element comprises a semiconductor material body of single-crystal type of a first conductivity type, the head further including a stack of layers arranged on top of said semiconductor material body, said stack comprising:

at least one first dielectric layer arranged on top of said semiconductor material body;

a heater element of electrically conductive material disposed on said first dielectric layer;

a second dielectric layer placed above said heater element;

a barrier layer disposed on said second dielectric layer and accommodating said ink chamber in a position above said heater element; and a closure layer disposed on said barrier layer and defining said nozzle, said integrated resistive element being formed in said semiconductor material body underneath said stack of layers, aligned with said ink chamber and having a second conductivity type.

2. A head according to claim 1, further comprising contact structures extending through said at least one first dielectric layer as far as said integrated resistive element.

3. A head according to claim 1, wherein said semiconductor material body has a predetermined crystallographic orientation and said integrated resistive element is coil-shaped and has a predetermined coil orientation correlated to said crystallographic orientation.

4. A head according to claim 1, further comprising integrated electronic components arranged in a position adjacent to said integrated inkjet print head.

5. An integrated inkjet print head emitting ink drops and comprising; an ink chamber a nozzle in communication with said ink chamber, and a drop emission sensor arranged in a position adjacent to said ink chamber, wherein said integrated head generates a recoil upon the ejection of an ink droplet, and said drop emission sensor senses said recoil;

wherein said drop emission sensor is a pressure sensor arranged adjacent a wall of said ink chamber, opposite said nozzle;

wherein said drop emission sensor is formed by an integrated resistive element;

wherein said integrated resistive element is made of multi-crystal silicon;

wherein the integrated resistive element comprises a semiconductor material body, and further including a stack of layers arranged on top of said semiconductor material body, said stack comprising:

an oxide layer on top of said semiconductor material body;

a first dielectric layer placed above said oxide layer;

a heater element of conductive material placed above said dielectric layer;

a second dielectric layer placed above said heater element;

a barrier layer accommodating said ink chamber in position above said heater element and said second dielectric layer; and a closure layer placed above said barrier layer and defining said nozzle, said integrated resistive element being arranged between said oxide layer and first dielectric layer, aligned with said ink chamber.

6. The head according to claim 5, wherein the oxide layer is a field oxide layer.

7. A head according to claim 5, further comprising integrated electronic components arranged in a position adjacent to said inkjet print head.

8. A process for manufacturing an inkjet print head, comprising the steps of forming an ink chamber and a nozzle in communication with said ink chamber, and forming a drop emission sensor in a position outside of but proximate to said ink chamber:

wherein said step of forming a drop emission sensor comprises the step of forming a resistive element adjacent a wall of said ink chamber opposite said nozzle;

wherein said step of forming a resistive element comprises the step of integrating said resistive element in a semiconductor material body of single-crystal type;

in which said semiconductor material body has a first conductivity type, comprising the steps of:

introducing ionic dopants causing a second conductivity type in said semiconductor material body so as to form said resistive element;

forming at least an oxide on top of said semiconductor material body;

forming a heater element of conductive material on top of said oxide and aligned with said resistive element;

forming a first dielectric layer on top of said heater element and said oxide;

forming a barrier layer on top of said first dielectric layer and accommodating said ink chamber in a position above said heater element; and forming a closure layer defining said nozzle on top of said barrier layer.

9. A process according to claim 8, wherein said step of introducing is carried out at said same time as a step of forming at least one active region of said second conductivity type for the formation of an integrated electronic component.

10. A process according to claim 8, wherein said semiconductor material body has a predetermined crystallographic orientation and said resistive element is coil-shaped and has a predetermined coil orientation correlated to said crystallographic orientation.

11. A process for manufacturing an inkjet print head, comprising the steps of forming an ink chamber and a nozzle in communication with said ink chamber, and forming a drop emission sensor in a position outside of but proximate to said ink chamber;

wherein said step of forming a drop emission sensor comprises the step of forming a resistive element adjacent a wall of said ink chamber opposite said nozzle;

wherein said step of forming a resistive element comprises the step of forming a resistor of multi-crystal semiconductor material on top of a semiconductor material body of single-crystal type;

wherein before said step of forming a resistive element, the following steps are carried out:

forming electrically conductive regions embedded in said semiconductor material body; and forming an oxide layer on top of said semiconductor material body; and in that, after said step of forming a resistive element, the following steps are carried out:

forming a first dielectric layer superimposed on said resistive element and oxide layer;

forming a heater element of conductive material on top of said first dielectric layer and aligned with said resistive element;

forming a second dielectric layer on top of said heater element and said second dielectric layer;

forming a barrier layer on top of said second dielectric layer and accommodating said ink chamber in a position above said heater element; and forming a closure layer defining said nozzle on top of said barrier layer.

12. A process according to claim 11, wherein said step of forming a resistive element comprises the steps of depositing a layer of multi-crystal semiconductor material and shaping said layer of multi-crystal semiconductor material to form at the same time said resistive element and at least one gate region of a field-effect MOS transistor.

13. The method of claim 11, wherein the oxide layer is a field oxide layer.

* * * * *

UNITED STATES PATENT AND TRADEMARK OFFICE

CERTIFICATE OF CORRECTION

PATENT NO. : 6,513,898 B1 
DATED : February 4, 2003
INVENTOR(S) : Benedetto Vigna and Riccardo Maggi It is certified that error appears in the above-identified patent and that said Letters Patent is hereby corrected as shown below:

Column 4,
Line 51, please replace “40” with -- 30 --.

Signed and Sealed this

Seventeenth Day of June, 2003

JAMES E. ROGAN
*Director of the United States Patent and Trademark Office*